United States Patent [19]

Efird et al.

[11] Patent Number: 4,736,468

[45] Date of Patent: Apr. 12, 1988

[54] METHOD OF FORMING A BRIEF

[75] Inventors: Lee A. Efird, Kernersville; Sherrill B. Coggins, Winston-Salem; Howard D. Boyles, King, all of N.C.

[73] Assignee: Sara Lee Corporation, Winston-Salem, N.C.

[21] Appl. No.: 54,183

[22] Filed: May 26, 1987

[51] Int. Cl.[4] ..... A41B 9/00

[52] U.S. Cl. ..... 2/400; 2/243 R; 2/403; 2/406

[58] Field of Search ..... 2/400, 402, 403, 406, 2/409, 203 R

[56] References Cited

U.S. PATENT DOCUMENTS

| | | | |
|---|---|---|---|
| 1,987,965 | 1/1935 | Meares . | |
| 3,245,407 | 4/1966 | Mason | 2/400 X |
| 3,375,530 | 4/1968 | Matthews et al. . | |
| 3,985,004 | 10/1976 | Johnson et al. . | |
| 4,031,568 | 6/1977 | Huff . | |
| 4,101,982 | 7/1978 | Muller . | |
| 4,173,976 | 11/1979 | Bloomquist et al. . | |
| 4,615,051 | 10/1986 | Hashimoto . | |
| 4,624,115 | 11/1986 | Safrit et al. . | |

FOREIGN PATENT DOCUMENTS

| | | | |
|---|---|---|---|
| 1212617 | 10/1959 | France | 2/402 |
| 2093212 | 1/1972 | France | 2/409 |

*Primary Examiner*—H. Hampton Hunter

*Attorney, Agent, or Firm*—Charles Y. Lackey; William S. Burden

[57] ABSTRACT

A method of producing panties, briefs, or the like from seamless knit tubular blanks. First and second tubular blanks are slit longitudinally along the entire length thereof and when opened out flat define first and second panels. A third tubular blank substantially smaller in length and diameter than the first and second blanks is slit along one side to define a crotch panel. A crotch panel is secured to each of the first and second panels and the first and second panels are folded upon each other with selected overlying edges attached to each other thereby providing a panty or brief having front and back portions defined by the first and second panels.

11 Claims, 2 Drawing Sheets

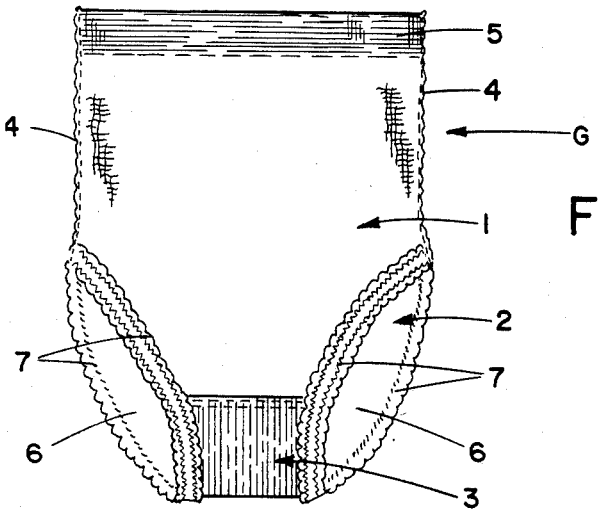
FIG. 1
FIG. 2
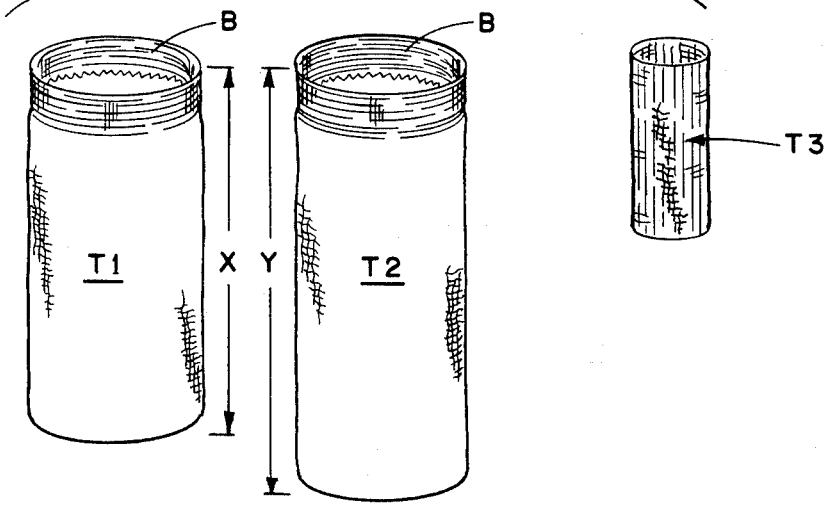
FIG. 3
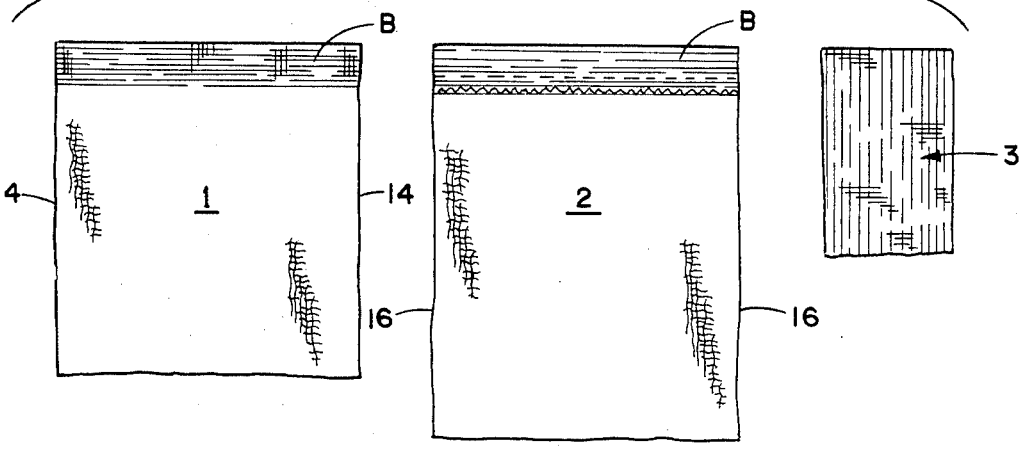

METHOD OF FORMING A BRIEF

BACKGROUND, BRIEF SUMMARY AND OBJECTS OF THE INVENTION

The present invention relates to the fabrication of garments such as panties, briefs, bathing suits, or any number of garments covering the lower part of a wearer's trunk from the waist downward, anad having leg openings on opposite sides of a crotch portion.

In the fabrication of conventional lower torso body garments, one method includes providing a single flate fabric blank capable of being seamed to provide a garment having spaced front and back sections with inwardly and oppositely inclined edges defining the fronts and backs of the leg openings and an intervening, substantially narrower crotch portion. This method is referred to in U.S. Pat. No. 3,985,004 to Johnson et al. Other methods include forming an elongated tubular blank having a narrow section intermediate relatively wider sections. The tubular blank is slit the entire length thereof, opened out flat, and folded with the wider sections in overlying relationship and the edges thereof sewn together. Another method includes forming a brief from an elongated tubular blank having a length of about twice the length of the desired finished product. The tube is slit along the side and an arcuate segment is cut from the slit edge midway of the tubular blank length. The slitted tube is then opened, the blank folded, and the sides stitched together to form a garment. Such methods are illustrated in U.S. Pat. Nos. 3,375,530 and 3,985,004. Other known methods are disclosed by U.S. Pat. Nos. 1,985,965; 4,173,976; 4,031,568; 4,624,115; and 4,615,051.

The present invention is directed to a new and improved method of fabricating panties, briefs, and the like.

In a preferred embodiment the method includes forming three fabric tubes, two of such tubes being somewhat similar in diameter and length and the third tube being substantially smaller in length and diameter than the other two tubes. Each of the two larger tubes may include an elastic band section at one end thereof. Each of the two larger tubes is slit lengthwise to form two generally rectangular panels. The small tube is slit lengthwise along one side thereby forming a crotch panel. The crotch panel is then secured to the two larger panels, and the two larger panels positioned in superposed relation and then secured together along selected overlying edge portions. Prior to securing the two larger panels to each other selected portions may be severed therefrom to define tapered or arcuate edges and leg opening elastic may be applied thereto.

One of the primary objects of the invention is the provision of a new and improved system for forming a panty, brief, or the like from three elongated tubular fabric blanks.

Another object of the invention is the provision of a method of manufacture of an article of apparel utilizing three tubular knit fabric blanks.

Further objects, features and advantages of the invention will become apparent from a consideration of the following description, the claims and the accompanying drawings.

BRIEF DESCRIPTION OF THE DRAWINGS

FIG. 1 is a front elevational view of a garment constructed in accordance with the present invention;

FIG. 2 is an elevational view of three blanks used in forming a garment;

FIG. 3 is an elevational view of three panels formed from the tubular blanks of FIG. 2.;

DETAILED DESCRIPTION OF THE INVENTION

Figure 4:
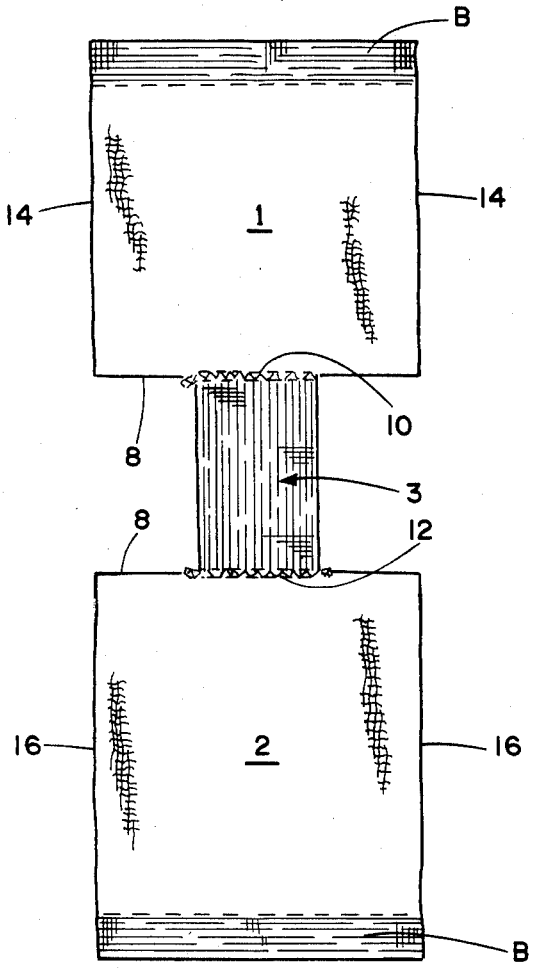
FIG. 4 is an elevational view of the three panels in partially assembled relation.

Referring to the drawing wherein like numerals represent like parts throughout the several views, a garment generally designated G includes a front panel 1 for covering the lower abdomen, a rear panel 2 for covering the buttocks, and a crotch panel 3 interconnecting the front and rear panels at the bottom thereof. The front and rear panels are connected by side seams 4. An elastic waistband 5 extends around the top portion of the garment and leg elastic bands 7 are attached to edge portions of the front, rear, and crotch panels 1, 2, 3 defining the leg openings 6.

Throughout the specification and claims, the terms "upper", "lower", "front", "side, "rear", and "back" used in referring to the garment and components thereof are based on the garment as worn on the body.

The garment disclosed is fabricated from three tubular knit blanks T1, T2 and T3, as shown by FIG. 2. The circularly knit tubular blanks T1 and T2 may be formed on a conventional knitting machine. The same or a similar type knitting machine may be used to knit the tubular blank T3.

The two blanks T1 and T2 are of similar construction and diameter and each may be provided with integrally knit waistbands B. However, the lengths vary slightly. The length Y of blank T2 is a little longer than the length X of blank T1 to provide adequate room in the back of the brief G. The tubular blank T3 is of reduced length and of reduced diameter compared to the blanks T1 and T2. The lengths and diameters of the three blanks may be altered to provide different variations in order to selectively provide the desired particular shape, contour, size, etc. of the garment.

The blanks T1, T2 and T3 may be of various types materials such as is conventionally utilized for the production of panties, briefs or the like. Although not essential to the invention, in a preferred embodiment, the blank T3 includes cotton such as conventionally used in such undergarments.

The tubes T1 and T2 are slit lengthwise to form front and rear panels 1 and 2 having severed edge portions 14, 16, FIG. 3, when opened flat. The tube T3 is slit lengthwise along one side to define a crotch panel 3, as shown by FIG. 3.

The crotch panel 3 is secured as shown by FIG. 4, to the lower or bottom edges 8 of the panels 1, 2 opposite the elastic bands B, B by stitching or other suitable means as shown at 10, 12.

Figure 5:
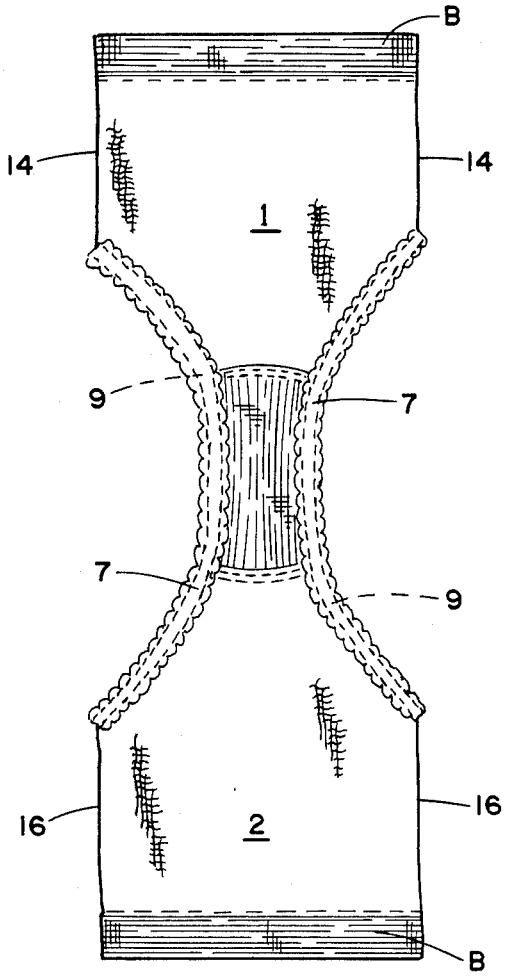
FIG. 5 is an elevational view similar to FIG. 4 with portions of the panels trimmed away to define leg openings and having leg elastic applied thereto.
Figure 6:
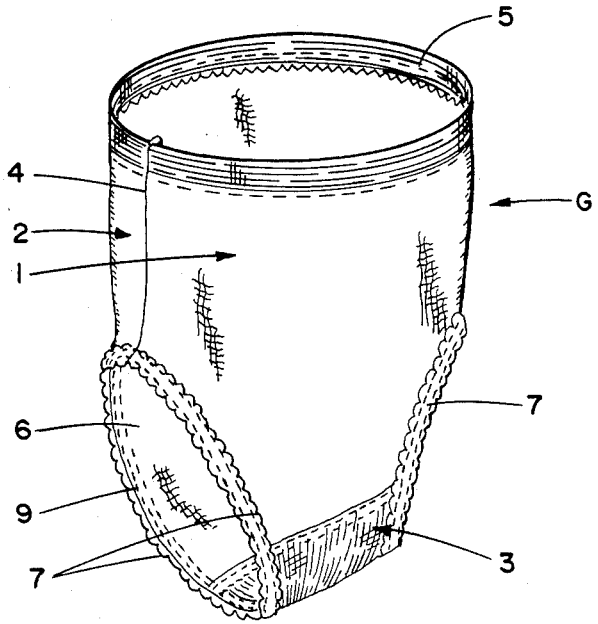
FIG. 6 is a perspective view of a completely assembled garment.

Portions of the panels 1 and 2, and panel 3, if desired, may be removed to provide prescribed contours or arcuately shaped areas 9, 9, as shown by FIG. 5. One of the panels 1 or 2 then is folded over the other panel in superposed relation with edge portions 14 and 16 aligned, and the panels are then secured along edge portions 14, 16 by side seams 4. The elastic bands B, B of the panels also are secured together by seams 4, 4 to define the garment waistband 5. Leg elastic strips 7 may be stitched to contour edges 9 after the front 1 and rear 2 panels are secured by side seams 4, 4 or prior to seaming of the panel edges 14, 16, as shown by FIG. 5.

While the above embodiment of the invention has been disclosed, it will be understood that the details of procedure and construction set out herein are merely by way of example and the invention is to be limited only by the scope of the appended claims.

What is claimed is:

1. A method of forming a brief comprising the steps of; forming discrete first, second and third tubular blanks, each having opposed upper and lower end portions, slitting longitudinally from end portion to end portion each of said first and said second tubular blanks to define first and second panels, each panel having an upper end portion and a lower end portion and opposed slit edge portions extending between the upper and lower end portions, slitting the third tubular blank longitudinally throughout its length to form a crotch panel, interconnecting said first and second panels by stitching said crotch panel to selected portions of said first and second panels, positioning the first and second panels in overlying relation, and stitching together selected slit edge portions of the first and second panels to define side seams for a brief having a torso encircling portion provided with leg openings.

2. The method as recited in claim 1 wherein the third tubular blank varies in length and diameter from the first and second blanks.

3. The method as recited in claim 1, wherein the upper end portion of each of the first and second tubular blanks includes an elastic band.

4. The method as recited in claim 1, wherein the crotch panel is stitched to intermediate lower end portions of the first and second panels.

5. The method as recited in claim 3, wherein the elastic band of each of the first and second tubular blanks form the brief waistband when secured together by the side seams.

6. The method as recited in claim 1, further comprising removing selected portions from said first and second panels to define arcuate edge portions for providing the desired contour to the brief leg openings.

7. The method as recited in claim 6, and further including applying an elastic band to the arcuate edge portions of the first and second panels and the crotch panel.

8. The method of forming a brief comprising the steps of; forming a longitudinal slit from end to end in each of first and second elongated knit tubular blanks to define first and second panels, each panel having opposed severed edge portions extending between opposite end portions, slitting a third knit tubular blank having opposite end portions to form a crotchpanel substantially smaller in width and length than the first and second panels, seaming opposed portions of the crotch panel to selected end portions of the first and second panels, positioning the first and second panels in overlying relation with the severed edge portions of each generally aligned, and seaming together the severed edge portions of the overlying first and second panels.

9. The method as recited in claim 8, wherein an end portion of each of the first and second tubular blanks has an elastic band portion integrally knit therein.

10. The method as recited in claim 8, wherein prior to the step of positioning the first and second panels in overlying relation, severing selected portions from each of the first and second panels to define arcuate edge portions for providing leg openings of the desired contour in the assembled brief.

11. The method as recited in claim 10, and further including the step of applying leg elastic to the arcuate edge portions of the first and second panels.

* * * * *